US010941591B2

(12) United States Patent
Cho et al.

(10) Patent No.: US 10,941,591 B2
(45) Date of Patent: Mar. 9, 2021

(54) VEHICLE TAILGATE LOCKING DEVICE

(71) Applicants: Hyundai Motor Company, Seoul (KR); Kia Motors Corporation, Seoul (KR); Pyeong Hwa Automotive Co., Ltd., Daegu (KR)

(72) Inventors: Ki Hyun Cho, Suwon-si (KR); Ji-Hak Yoo, Suwon-si (KR)

(73) Assignees: Hyundai Motor Company, Seoul (KR); Kia Motors Corporation, Seoul (KR); Pyeong Hwa Automotive Co., Ltd., Daegu (KR)

( * ) Notice: Subject to any disclaimer, the term of this patent is extended or adjusted under 35 U.S.C. 154(b) by 446 days.

(21) Appl. No.: 15/785,084

(22) Filed: Oct. 16, 2017

(65) Prior Publication Data

US 2018/0223568 A1 Aug. 9, 2018

(30) Foreign Application Priority Data

Feb. 7, 2017 (KR) ..... 10-2017-0016687

(51) Int. Cl.

| | |
|---|---|
| ***E05B 81/74*** | (2014.01) |
| ***E05B 81/14*** | (2014.01) |
| *E05B 81/30* | (2014.01) |
| *E05B 83/18* | (2014.01) |
| *E05B 81/34* | (2014.01) |
| *E05B 81/06* | (2014.01) |

(52) U.S. Cl.

CPC ..... *E05B 81/15* (2013.01); *E05B 81/06* (2013.01); *E05B 81/30* (2013.01); *E05B 81/34* (2013.01); *E05B 83/18* (2013.01)

(58) Field of Classification Search

CPC ..... E05B 81/06; E05B 81/15

See application file for complete search history.

(56) References Cited

U.S. PATENT DOCUMENTS 4,334,704 A * 6/1982 Yamada ..... E05B 79/12 292/216
5,738,393 A * 4/1998 Chao ..... E05B 83/24 292/216

(Continued)

FOREIGN PATENT DOCUMENTS

| | | | | |
|---|---|---|---|---|
| CN | 103998704 A | | 8/2014 | |
| DE | 102006012105 A1 | * | 9/2007 | ..... E05B 81/14 |
| JP | 3143586 B2 | * | 3/2001 | |

*Primary Examiner* — Carlos Lugo

(74) *Attorney, Agent, or Firm* — Morgan, Lewis & Bockius LLP

(57) ABSTRACT

A vehicle tailgate locking device may include a latch assembly configured to engage or disengage a striker, wherein the latch assembly includes a housing, a latch member disposed in the housing and configured to engage or disengage the striker by rotation, a pawl member rotatably disposed in the housing to restrain or release the latch member, a driving device configured to rotate the pawl member to release restraint of the latch member, an engaging member configured to restrain the pawl member by engaging the pawl member when the pawl member rotates to a position releasing restraint of the latch member, and a releasing portion configured to press the engaging member to release the restraint of the pawl member when the latch member is rotated to a position releasing the engagement of the striker.

5 Claims, 7 Drawing Sheets

(56) References Cited

U.S. PATENT DOCUMENTS

| | | | | |
|---|---|---|---|---|
| 5,897,148 | A * | 4/1999 | Arabia, Jr. | E05B 85/243 292/209 |
| 5,934,717 | A * | 8/1999 | Wirths | E05B 81/14 292/201 |
| 6,109,671 | A * | 8/2000 | Roncin | E05B 81/14 292/201 |
| 6,267,420 | B1 * | 7/2001 | Miyagawa | E05B 83/16 292/216 |
| 7,810,853 | B2 * | 10/2010 | Margheritti | E05B 81/25 292/216 |
| 8,348,310 | B2 * | 1/2013 | Vazquez | E05B 85/26 292/216 |
| 8,684,424 | B2 * | 4/2014 | Wattebled | E05B 77/36 292/216 |
| 8,764,077 | B2 * | 7/2014 | Takagi | E05B 77/06 292/336.3 |
| 9,194,162 | B2 * | 11/2015 | Perkins | E05B 81/28 |
| 9,663,978 | B2 * | 5/2017 | Saravia Terricabras | E05B 81/15 |
| 2001/0010427 | A1 * | 8/2001 | Roos | E05B 81/14 292/201 |
| 2003/0160461 | A1 * | 8/2003 | Promutico | D06F 37/42 292/216 |
| 2006/0125245 | A1 * | 6/2006 | Graute | E05B 81/14 292/216 |
| 2015/0233156 | A1 * | 8/2015 | Scholz | E05B 85/20 292/200 |
| 2017/0191289 | A1 * | 7/2017 | Perkins | E05B 77/04 |
| 2018/0044950 | A1 * | 2/2018 | Distefano | E05B 81/14 |

* cited by examiner

VEHICLE TAILGATE LOCKING DEVICE

CROSS-REFERENCE(S) TO RELATED APPLICATIONS

The present application claims priority to Korean Patent Application No. 10-2017-0016687, filed on Feb. 7, 2017, the entire contents of which is incorporated herein for all purposes by this reference.

BACKGROUND OF THE INVENTION

Field of the Invention

Embodiments of the present invention relate to a vehicle tailgate locking device capable of stabilizing lock and unlock operations of a tailgate.

Description of Related Art

A tailgate locking device disposed at the rear of a vehicle can be unlocked by operating a switch disposed on a driver's seat side or a key box provided outside the tailgate.

The tailgate locking device may include a striker fixed to a vehicle body, and a latch assembly for engaging or disengaging the striker. The latch assembly includes a latch member rotatably disposed in a housing and configured to restrain or release the striker by rotation, a pawl member restraining or releasing the latch member to maintain or release a locked state, and a driving device actuating the pawl member to release the latching member by the operation of a driver.

The driving device of the latch assembly operates the pawl member to release the restraint of the latch member when electrical power is supplied. The latch member released from the pawl member unlocks the tailgate by rotating in the direction of releasing the restraint of the striker.

In the tailgate locking device, the time to supply power to the drive device for unlocking is very short. That is, the driving device is returned to the home position after operating the pawl member in the releasing direction for a short time. Accordingly, it can occur a problem that the tailgate locking device is locked by returning the pawl member again when the latch member does not rotate to the unlocked state within the short time for which the drive device operates. However, it is not also good to make the time for supplying electric power to the drive device too long. When the drive device is operated for a long time and the release time of the latch member becomes long, the tailgate locking device may not lock when the tailgate is opened for a short time and then immediately closed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a vehicle tailgate locking device configured for stabilizing lock and unlock operations of a tailgate.

Additional aspects of the present invention will be set forth in part in the description which follows and, in part, will be obvious from the description, or may be learned by practice of the present invention.

In accordance with an aspect of the present invention, a vehicle tailgate locking device including a latch assembly configured to engage or disengage a striker, wherein the latch assembly includes a housing, a latch member disposed in the housing and configured to engage or disengage the striker by rotation, a pawl member rotatably disposed in the housing to restrain or release the latch member, a driving device configured to rotate the pawl member to release restraint of the latch member, an engaging member configured to restrain the pawl member by engaging the pawl member when the pawl member rotates to a position releasing restraint of the latch member, and a releasing portion configured to press the engaging member to release the restraint of the pawl member when the latch member is rotated to a position releasing the engagement of the striker.

The pawl member may include a first engaging jaw which is engaged with the engaging member, and the engaging member may include a second engaging jaw with which the first engaging jaw is engaged.

The engaging member is formed integrally or monolithically with the housing, and may include a portion elastically deformable which is connected to the housing and a remaining portion separated from the housing by incision.

The engaging member may include a protrusion protruding toward the releasing portion at a position corresponding to the releasing portion, and the releasing portion may include a pressing portion provided on the latch member to protrude along a rotational locus and an inclined surface formed obliquely at the tip of the pressing portion.

The driving device may include a worm wheel rotatably disposed in the housing and having a protrusion configured to rotate a free end portion of the pawl member, a worm coupled to an external periphery of the worm wheel, and a motor for rotating the worm.

The pawl member may include a restricting portion formed of a metal material and having a restricting jaw rotatably coupled to the housing to restrict the latch member; and an extension formed of a resin material and extending toward the protrusion of the worm wheel in a state of being coupled to the restricting portion.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
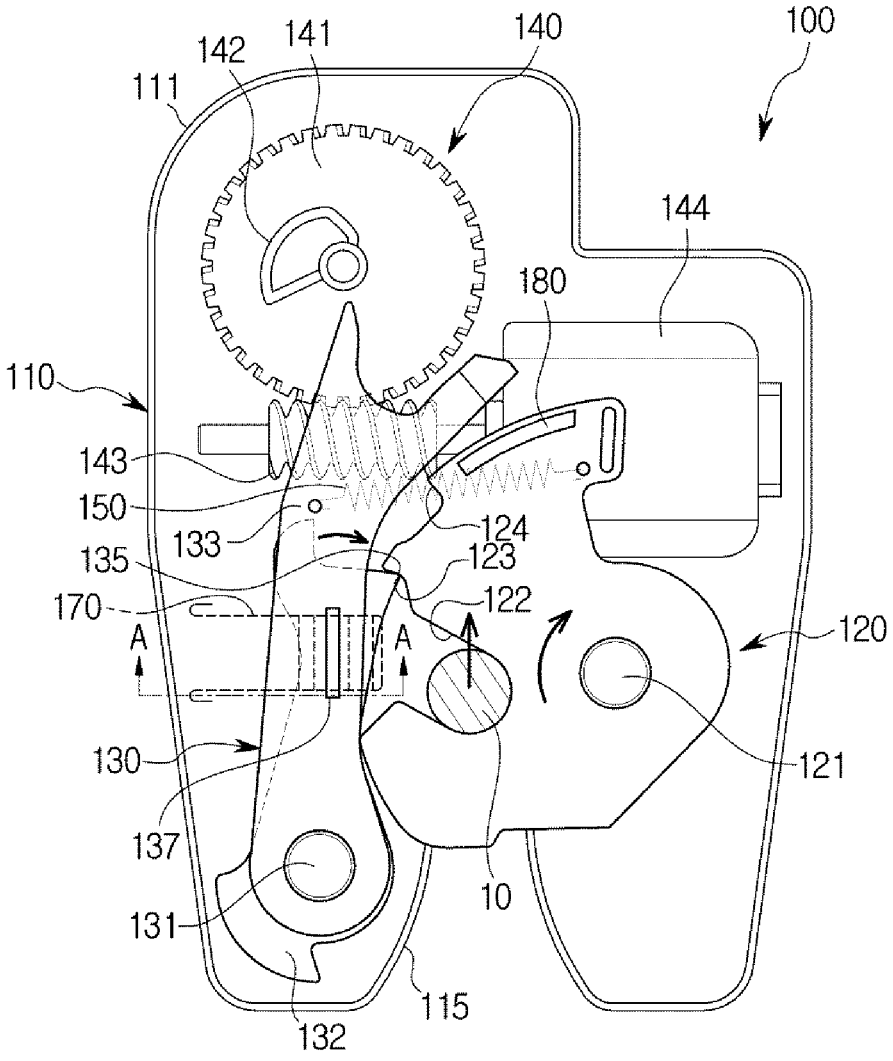
FIG. 1 shows a plan view of a latch assembly according to an exemplary embodiment of the present invention, depicting which a pawl member restrains a latch member in a state in which a latch member is engaged with a striker.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is intended to cover not only the exemplary embodiments, but also various alternatives, modifications, equivalents and other embodiments, which may be included within the spirit and scope of the invention as defined by the appended claims.

Figure 2:
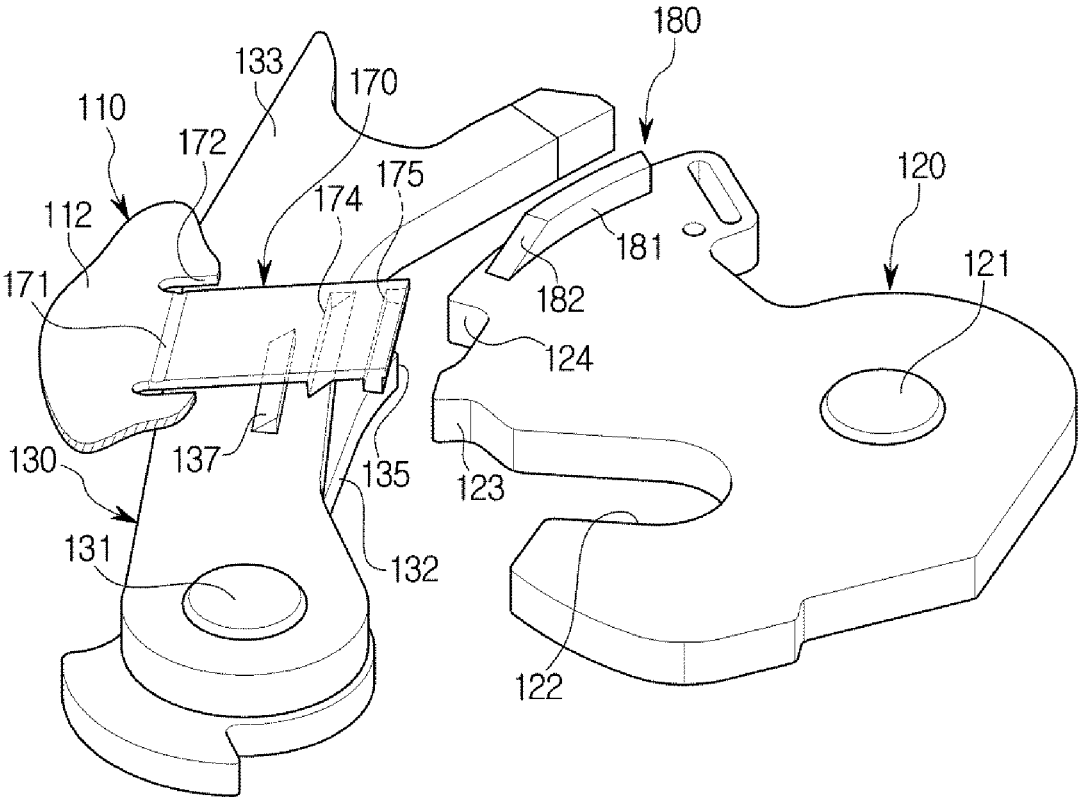
FIG. 2 shows a perspective view of the main portions of the latch assembly according to an exemplary embodiment of the present invention.
Figure 3:
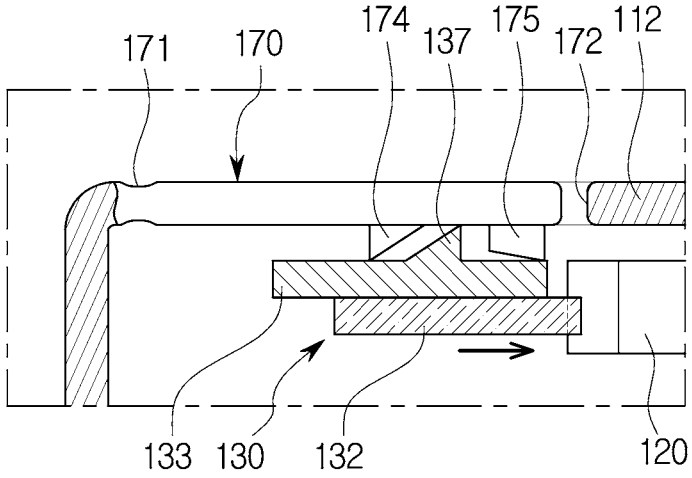
FIG. 3 is a sectional view taken along the line A-A of FIG. 1.

FIG. 1 is a plan view of a latch assembly according to an exemplary embodiment of the present invention, in which a pawl member restrains a latch member in a state in which a latch member is engaged with a striker, FIG. 2 is a perspective view depicting the main portions of the latch assembly, and FIG. 3 is a sectional view taken along the line A-A of FIG. 1.

Figure 4:
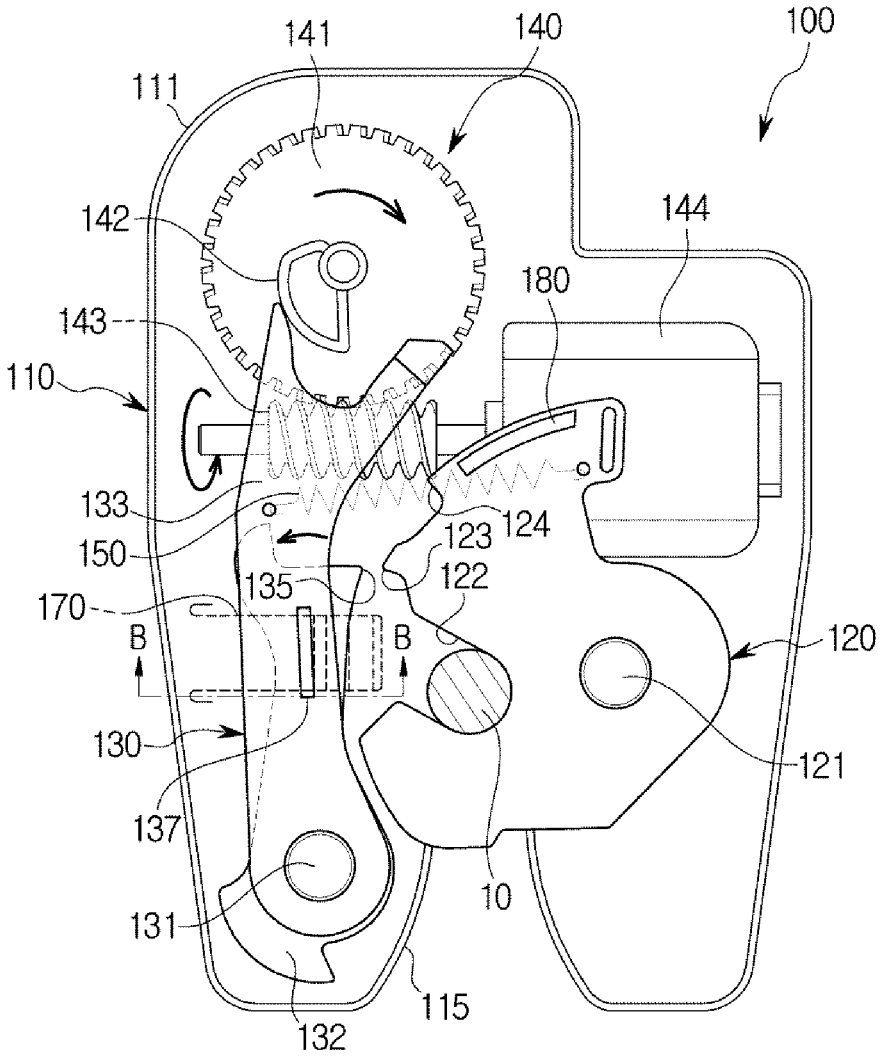
FIG. 4 is a plan view of the latch assembly according to an exemplary embodiment of the present invention, depicting a state in which the pawl member releases the restraint of the latch member.
Figure 5:
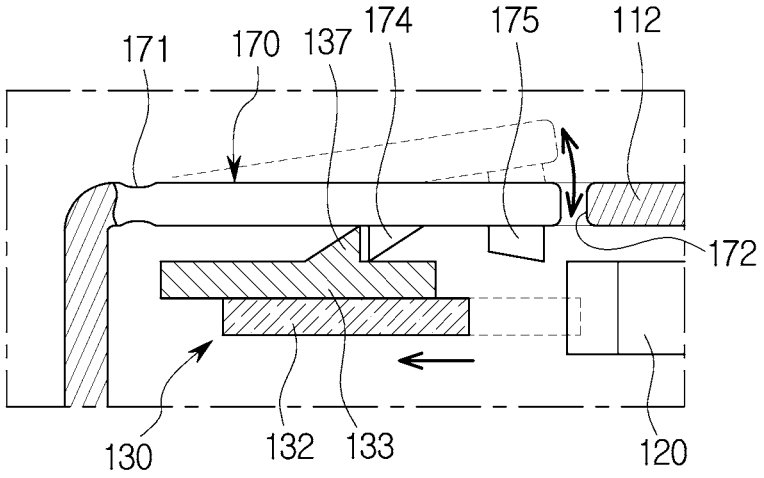
FIG. 5 is a sectional view taken along the line B-B of FIG. 4.
Figure 6:
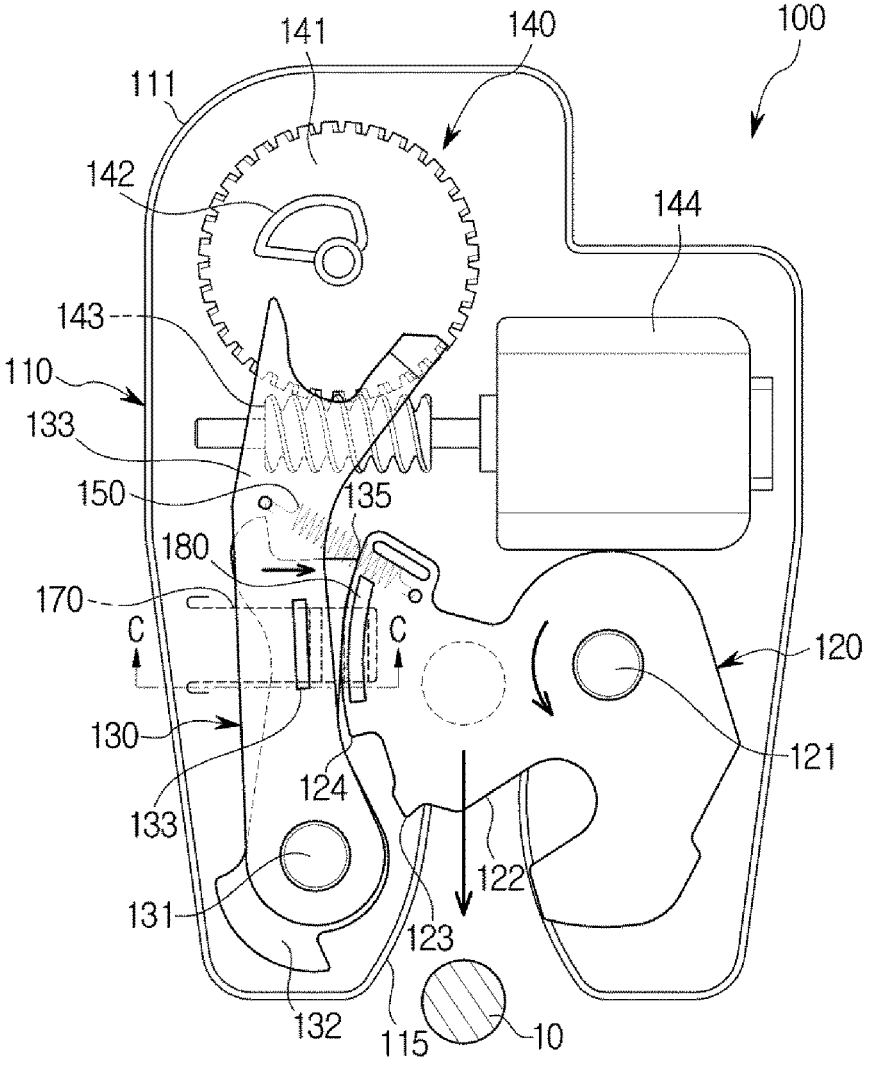
FIG. 6 is a plan view of the latch assembly according to an exemplary embodiment of the present invention, depicting a state in which the latch member is rotated to release the engagement of the striker.
Figure 7:
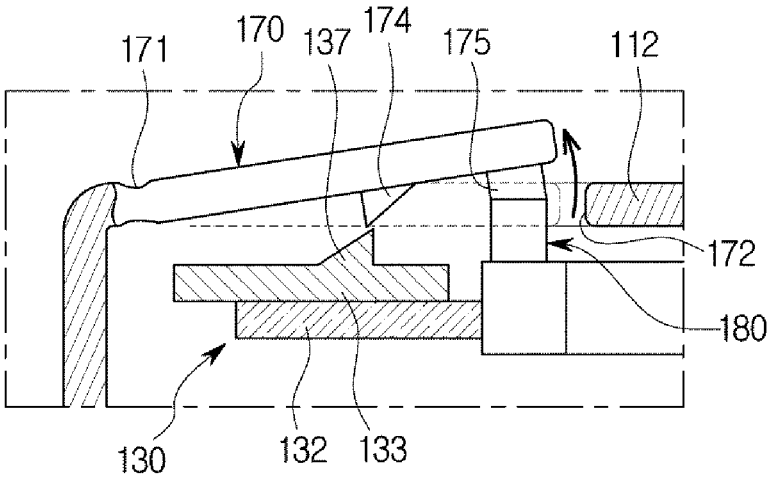
FIG. 7 is a sectional view taken along the line C-C of FIG. 6.

FIG. 4 is a plan view of the latch assembly depicting a state in which the pawl member releases the restraint of the latch member, and FIG. 5 is a sectional view taken along the line B-B of FIG. 4. FIG. 6 is a plan view of the latch assembly depicting a state in which the latch member is rotated to release the engagement of the striker, and FIG. 7 is a sectional view taken along the line C-C of FIG. 6.

Referring to FIG. 1 to FIG. 3, the vehicle tailgate locking device according to the present embodiment includes a striker 10 disposed in a vehicle body and a latch assembly 100 disposed on a tailgate of the vehicle to engage or disengage the striker 10.

As illustrated in FIG. 1 and FIG. 2, the latch assembly 100 includes a housing 110, a latch member 120 disposed in the housing 110 configured to engage or disengage the striker 10, a pawl member 130 rotatably disposed in the housing and restraining or releasing the latch member 120, a driving device 140 that rotates the pawl member 130 to release restraint of the latch member 120, and an operating spring 150 configured for applying a rotational force to the pawl member 130.

The housing 110 accommodates the latch member 120, the pawl member 130, the driving device 140, and the like. The housing 110 may include a lower housing 111 and an upper housing 112 (see FIG. 2) that covers the upper portion of the lower housing 111. In FIG. 1 the upper housing 112 is not shown to clearly show the components disposed inside the housing 110. An entrance guide groove 115 is formed at the housing 110 to guide the striker 10 toward the latch member 120.

As illustrated in FIG. 1 and FIG. 2, the latch member 120 may be formed in a substantially flat plate shape by a metal material. The latch member 120 is rotatably supported by a first support shaft 121 fixed to the housing 110. The latch member 120 includes a coupling groove 122 that is radially opened to engage with the striker 10 that enters the entrance guide groove 115.

The latch member 120 has a first restraining jaw 123 and a second restraining jaw 124 provided on the upper side of the coupling groove 122 so that the rotation of the latch member 120 can be restricted by the pawl member 130. When the first restraint 123 is caught by the restraining jaw 135 of the pawl member 130, as shown in FIG. 1, the coupling groove 122 can seize the striker 10 which has completely entered the entering guide groove 115. When the second restraining jaw 124 is caught by the restraining jaw 135 of the pawl member 130, the coupling groove 122 can seize the striker 10 which has entered approximately half of the entrance guide groove 115.

The driving device 140 may include a worm wheel 141 rotatably disposed on the upper side of the housing 110 and having a protrusion 142 for rotating a free end portion of the pawl member 130, a worm 143 engaged with the external periphery of the worm wheel 141, and a motor 144 for rotating the worm 143.

The pawl member 130 is rotatably disposed on the side of the latch member 120 inside the housing 110 so that the pawl member 130 can be engaged with the first or second restraining jaws 123 or 124 of the latch member 120. The pawl member 130 includes one end portion rotatably supported on the second support shaft 131 fixed to the housing 110 and the other end portion elongated toward the protrusion 142 of the worm wheel 141.

Referring to FIG. 2, the pawl member 130 includes a restricting portion 132 formed of a metal material and having one end portion rotatably supported on the second support shaft 131 and the other end portion provided with the restraining jaw 135 to restrict the first and second restraining jaws 123 and 124 of the latch member 120, and an extension 133 formed of a resin material and extending toward the protrusion 142 of the worm wheel 141 in a state of being coupled to the restricting portion 132.

Since the pawl member 130 includes the restraining portion 132 including a relatively heavy metal material and the extension 133 including a relatively light resin material, the total weight of the pawl member 130 can be reduced. In addition, the center of gravity of the pawl member 130 may be offset toward the second support shaft 131 which is the center of rotation. Accordingly, smooth rotation of the pawl member 130 can be achieved.

The operation spring 150 may be a tension coil spring having one end portion coupled to the upper side of the pawl member 130 and the other end portion coupled to the upper side of the latch member 120. The operating spring 150 provides a rotational force so that the latch member 120 and the pawl member 130 can rotate in opposite directions. Thus, the operating spring 150 can rotate the latch member 120 in the counterclockwise direction and rotate the pawl member 130 in the clockwise direction.

As illustrated in FIG. 1, since the pawl member 130 tends to rotate normally in the clockwise direction due to the pulling of the operating spring 150, the restraining jaw 135 can be engaged with the first restraining jaw 123 or the second restraining jaw 124 of the latch member 120. As illustrated in FIG. 6, since the latch member 120 tries to rotate counterclockwise by the pulling of the operating spring 150, when the restraint by the pawl member 130 is released, the latch member 120 can be rotated to release the engagement of the striker 10.

Referring to FIG. 1, when the tailgate is closed, the striker 10 enters the entrance guide groove 115 of the latch assembly 100. The striker 10 then enters the coupling groove 122 of the latch member 120 and is engaged with the coupling groove 122 of the latch member 120 by rotating the latch member 120 in the clockwise direction. In addition, the restraining jaw 135 of the pawl member 130 restrains the first restraining jaw 123 of the latch member 120 to limit the rotation of the latch member 120 in the reverse direction. Therefore, the latch assembly 100 can maintain the seizing state of the striker 10.

Referring to FIG. 4, when a driver operates the switch or the like to open the tailgate, the motor 144 rotates and the worm wheel 141 rotates clockwise by the rotation of the motor 144. At the present time, the protrusion 142 of the worm wheel 141 slightly rotates the pawl member 130 counterclockwise. Thus, the restraint of the latch member 120 by the restraining jaw 135 of the pawl member 130 is released. When the tailgate is opened in the present state, as shown in FIG. 6, the latch member 120 rotates in the counterclockwise direction and the seized state of the striker 10 is released.

Meanwhile, the driving device 140 operates the pawl member 130 in the restraint releasing direction for a short time. Accordingly, in the state of FIG. 4, when the opening operation of the tail gate is delayed, the conventional latch assembly can rotate the pawl member 130 again in the reverse direction, restricting the latch member 120. When the latch member 120 does not rotate sufficiently in the direction of releasing the engagement within a short time period in which the driving device 140 operates the pawl member 130, the restraining jaw 135 of the pawl member 130 is returned again to the latch member 120. Therefore, the second restraining jaw 124 of the latch member 120 can be restrained by the restraining jaw 135 of the pawl member 130, so that the restraint cannot be released.

However, as illustrated in FIG. 4 to FIG. 7, The latch assembly 100 of the present embodiment includes an engaging member 170 configured for restraining the pawl member 130 when the pawl member 130 rotates in a state where the latch member 120 is released from the restraint, and a releasing portion 180 for releasing the restraint of the pawl member 130 by pushing up the engaging member 170 when the latch member 120 rotates in a state of releasing the engagement of the striker 10. Therefore, the above-mentioned problems can be solved. That is, a half locking phenomenon due to delay of tail gate opening can be prevented.

Referring to FIG. 2 and FIG. 3, the engaging member 170 may be disposed on one side of the upper housing 112 covering the pawl member 130, and may be integrally formed with the upper housing 112. That is, the engaging member 170 can be formed integrally or monolithically with the upper housing 112 by injection molding.

As illustrated in FIG. 2, a portion of the engaging member 170 is elastically deformable and connected to the upper housing 112, and a remaining portion of the engaging member 170 is separated from the upper housing 112 by the incision portion 172. Therefore, as shown in FIG. 5, the engaging member 170 can move up and down by the deformation of the elastic deforming portion 171.

Although the present embodiment shows a case which the engaging member 170 is provided integrally with the upper housing 112, the form of the engaging member 170 is not limited thereto. The engaging member may be separately provided and then disposed on the internal surface of the housing 110.

Referring to FIG. 3, the pawl member 130 includes a first engaging jaw 137 which is engaged with the engaging member 170, and the engaging member 170 includes a second engaging jaw 174 to which the first engaging jaw 137 is engaged.

As illustrated in FIG. 2, the releasing portion 180 may be provided integrally with the latch member 120. The releasing portion 180 may include a pressing portion 181 provided on the surface of the latch member 120 to protrude along a rotational locus and an inclined surface 182 formed obliquely to the tip of the pressing portion 181. The engaging member 170 may include a protrusion 175 protruding toward the releasing portion 180 at a position corresponding to the releasing portion 180.

As illustrated in FIG. 1 and FIG. 3, the first engaging jaw 137 of the pawl member 130 can be positioned between the second engaging jaw 174 of the engaging member 170 and the protrusion 175 of the engaging member 170, in a state which the latch member 120 is engaged with the striker 10.

When the pawl member 130 rotates counterclockwise to open the tailgate in the state of FIG. 3, as shown in FIG. 4 and FIG. 5, the first engaging jaw 137 of the pawl member 130 is caught by the second engaging jaw 174 beyond the second engaging jaw 174 of the engaging member 170. In the present process, as shown in FIG. 5, the engaging member 170 is slightly lifted and lowered, and the second engaging jaw 174 restrains the first engaging jaw 137. Therefore, the pawl member 130 does not rotate in the direction of restricting the latch member 120 even when the opening operation of the tailgate is delayed a little. The latch member 120 remains in the released state.

When the tailgate is opened in the state of FIG. 4 and FIG. 5, the latch member 120 rotates counterclockwise as shown in FIG. 6 and the engagement of the striker 10 is released. As illustrated in FIG. 6 and FIG. 7, when the latch member 120 rotates sufficiently in a direction to release the engagement of the striker 10, the releasing portion 180 of the latch member 120 is engaged with the protrusion 175 of the engaging member 170 and lifts up the free end portion of the engaging member 170. Thus, the first engaging jaw 137 of the pawl member 130 is released from the restraint, and the pawl member 130 is in a state configured for restraining the latch member 120 again.

When the tailgate is closed again in the state of FIG. 6, since the restraint of the pawl member 130 by the engaging member 170 is already released. As shown in FIG. 1 and FIG. 3, the restraining jaw 135 of the pawl member 130 can restrain the latch member 120 by catching the first restraining jaw 123 of the latch member 120. That is, in a state in which the latch member 120 binds the striker 10, the pawl member 130 restrains the latch member 120 so that the binding of the striker 10 is maintained.

As is apparent from the above description, the vehicle tailgate locking device according to the present embodiment is configured wherein the pawl member 130 is restrained by the engaging member 170 in a state in which the pawl member 130 releases the restraint of the latch member 120. The releasing portion 180 of the latch member 120 presses the engaging member 170 to release the restraint of the pawl member 130 in the state in which the latch member 120 is rotated to release the engagement of the striker 10. Therefore, the vehicle tailgate locking device of the present embodiment can stabilize the locking and unlocking operation of the tailgate, and can prevent the half-lock phenomenon due to the delay of the tailgate opening.

For convenience in explanation and accurate definition in the appended claims, the terms "upper", "lower", "internal", "outer", "up", "down", "upwards", "downwards", "front", "back", "rear", "inside", "outside", "inwardly", "outwardly", "internal", "external", "forwards" and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vehicle tailgate locking device comprising:

a latch assembly configured to engage or disengage a striker, wherein the latch assembly comprises a housing;

a latch member disposed in the housing and configured to engage or disengage the striker by rotation thereof;

a pawl member rotatably disposed in the housing to restrain or release the latch member;

a driving device configured to rotate the pawl member to release restraint of the latch member;

an engaging member configured to restrain the pawl member by engaging the pawl member when the pawl member rotates to a position releasing the restraint of the latch member; and a releasing portion configured to press the engaging member to release the restraint of the pawl member when the latch member is rotated to a position releasing an engagement of the striker, wherein the pawl member comprises a first engaging jaw which is engaged with the engaging member, wherein the engaging member comprises a second engaging jaw with which the first engaging jaw is engaged and a first protrusion spaced apart from the second engaging jaw and configured to be pressed by the releasing portion, wherein the first engaging jaw and the protrusion extend parallel to each other from a bottom side of the engaging member, and wherein the first engaging jaw of the pawl member is placed between the second engaging jaw and the first protrusion when the pawl member restrains the latch member in a state in which the latch member is engaged with the striker.

2. The vehicle tailgate locking device of claim 1, wherein the engaging member is formed integrally with the housing, and comprises a portion elastically deformably connected to the housing and a remaining portion separated from the housing by incision.

3. The vehicle tailgate locking device of claim 1, wherein the first protrusion is formed to protrude toward the releasing portion at a position corresponding to the releasing portion, and the releasing portion comprises a pressing portion provided on the latch member to protrude along a rotational locus and an inclined surface formed obliquely at a tip portion of the pressing portion.

4. The vehicle tailgate locking device of claim 1, wherein the driving device includes:

a worm wheel rotatably disposed in the housing and having a second protrusion configured to rotate a free end portion of the pawl member;

a worm coupled to an external periphery of the worm wheel; and a motor configured for rotating the worm.

5. The vehicle tailgate locking device of claim 4, wherein the pawl member comprises:

a restricting portion formed of a metal material and having a restricting jaw rotatably coupled to the housing to restrict the latch member; and an extension formed of a resin material and extending toward the second protrusion of the worm wheel in a state of being coupled to the restricting portion.

* * * * *